United States Patent [19]

LaBianca et al.

[11] Patent Number: 4,464,423

[45] Date of Patent: Aug. 7, 1984

[54] METHOD FOR FORMING DUAL GLOSS COATING

[75] Inventors: Michael H. LaBianca; Thomas G. Smith, both of Easton, Pa.

[73] Assignee: Tarkett AB, Ronneby, Sweden

[21] Appl. No.: 248,126

[22] Filed: Mar. 27, 1981

[51] Int. Cl.[3] ..... B05D 5/00

[52] U.S. Cl. ..... 427/244; 427/261; 427/264; 427/265; 427/373

[58] Field of Search ..... 427/261, 264, 270, 258, 427/244, 265, 373; 428/160

[56] References Cited

U.S. PATENT DOCUMENTS

| | | | |
|---|---|---|---|
| 3,259,515 | 7/1966 | Pecker | 427/261 X |
| 3,458,337 | 7/1969 | Rugg | 427/270 X |
| 4,017,658 | 4/1977 | Bomboire | 427/265 X |
| 4,273,819 | 6/1981 | Schmidle et al. | 427/264 X |
| 4,273,820 | 6/1981 | Swietzer | 428/160 X |

*Primary Examiner*—Evan K. Lawrence
*Attorney, Agent, or Firm*—Roberts & Floyd

[57] ABSTRACT

A dual gloss coating is formed on a substrate by first applying to the substrate a continuous layer of curable polyurethane or PVC plastisol or organosol. After the layer is at least partially cured, a second discontinuous layer of the same or different urethane or PVC plastisol or organosol is applied to selected areas of the surface of the first layer by rotogravure printing, using a rotogravure cylinder having a number of lines per inch sufficient to produce a difference in gloss effect between the discontinuous layer and the continuous layer after complete curing of the layers, and then completing the cure of the layers.

18 Claims, No Drawings

METHOD FOR FORMING DUAL GLOSS COATING

BACKGROUND OF THE INVENTION

Wear layers of clear polyurethane or polyvinyl chloride (PVC) plastisol or organosol are well known for use on a large variety of substrates including floor and wall tiles and decorative sheet type covering materials such as vinyl floor coverings. Such wear layers may be formulated to provide coatings with varying degrees of gloss and the production of materials such as sheet vinyl flooring having wear layers exhibiting different degrees of gloss in different areas is known.

SUMMARY OF THE INVENTION

It is an object of the present invention to provide a novel process for forming a dual gloss coating on a substrate. The process of the invention comprises:

(a) applying to the substrate a first, continuous layer of curable polyurethane or PVC plastisol or organosol and at least partially curing same;

(b) then applying with a rotogravure cylinder to selected areas of the surface of the thus at least partially cured continuous layer a second, discontinuous, printed layer of the same or a different curable polyurethane or PVC plastisol or organosol, said rotogravure cylinder having a number of lines per inch sufficient to produce a difference in gloss effect between the discontinuous layer and continuous layer after curing of said layers; and (c) then completing the curing of both said layers.

DETAILED DESCRIPTION OF THE INVENTION

The invention contemplates the formation of dual gloss coatings on a wide variety of substrates including such diverse materials as wood, glass, plastics, metals, paper, etc. The invention has particular applicability to tiles and decorative sheet covering material suitable for use on walls and floors, especially vinyl tiles and sheet vinyl. Especially striking results are obtained where the substrate is embossed and it is desired to provide a wear layer coating having different gloss levels in the embossed and unembossed areas of the substrate. In a preferred embodiment the invention is used in the production of sheet vinyl flooring and vinyl floor tiles. Suitable substrates for such purpose include conventional vinyl tile base, PVC plastisol or organosol layers, such as are commonly used in sheet vinyl flooring, etc. The substrate, especially where it is a PVC layer in flexible sheet vinyl flooring, may be further supported by other layers and substrates in a conventional manner. PVC layers used as substrates in practicing the invention may, for instance, be further supported on suitable supporting materials such as asbestos sheet, woven or nonwoven fibrous web, other PVC plastisol or organosol layers, PVC on latex sealed felt backing, etc. PVC layers suitable for substrates in practicing the invention may be foamed or foamable, or may be unfoamed and may be of any of the various PVC resin materials normally used in connection with coating of decorative sheet materials. Such substrates may include, but are not limited to the PVC plastic materials described in U.S. Pat. Nos. 3,458,337 and 3,293,094, the disclosures of which are incorporated herein by reference. Where appropriate, a substrate of the type described herein may include printing or other decorative effects superimposed thereon. Suitable vinyl tile base material typically comprises vinyl chloride polymer, filler and plasticizer. Such tile base may also include other conventional ingredients such as pigment, light and heat stabilizers, etc. Vinyl tile base as described in U.S. Pat. Nos. 3,991,006 or 3,924,023, the disclosures of which are incorporated herein by reference, is for instance, suitable for use in practicing the invention.

PVC plastisols and organosols suitable for use in practicing the invention may comprise any of the conventional PVC resin materials normally used in connection with coating of decorative sheet materials in the manufacture of tile or sheet vinyl goods and may include but are not limited to the PVC plastic materials described in U.S. Pat. Nos. 3,458,337 and 3,293,094. Likewise, polyurethane materials used in practicing the invention may comprise any of the conventional urethane compounds known for use as wear layers on vinyl tile or sheet vinyl goods. These may include urethane laquers as well as polyurethane prepolymer packages of the type well known in the art. While a wide variety of polyurethanes and polyurethane prepolymers may be used, it is generaly preferred where clear wear layers are desired to use polyurethane of the aliphatic or cycloaliphatic type since aromatic urethanes have a strong tendency towards discoloration.

Suitable polyurethanes may be prepared in a conventional manner such as by reacting hydroxylated polymers with organic polyisocyanates in the manner well known in the art. Suitable organic polyisocyanates include, for instance, ethylene diisocyanate; ethylidene diisocyanate; propylene-1,2-diisocyanate; cyclohexylene-1,2-diisocyanate; m-phenylene diisocyanate; 2,4-toluene diisocyanate; 2,6-toluene diisocyanate; 3,3'-dimethyl-4,4'-biphenylene diisocyanate; p,p',p''-triphenylmethane triisoene diisocyanate; 3,3'-diphenyl-4,4'-biphenylene diisocyanate; 4,4'-biphenylene diisocyanate; 3,3'-dichloro-4,4'-bipheneylene diisocyanate; p,p',p''-triphenylmethane triisocyanate; 1,5-nepthalene diisocyanate; furfurylidene diisocyanate or polyisocyanates, in a blocked or inactive form such as the bis-phenyl carbamates of 2,4- or 2,6 toluene diisocyanate; p,p'-diphenyl methane diisocyanate; p-phenylene diisocyanate; 1,5-naphthalene diisocyanate and the like.

Polyurethanes applied as coatings in accordance with the invention may, of course, be in the form of solutions in suitable solvents such as xylene, toluene, etc.

Materials for the polyurethane coatings may be supplied in 1 package or 2 package prepolymer systems or oil modified systems, etc., all in the manner well known in the industry. Such materials are described for instance in the pamphlet "Urethane Coatings," published by the Federation of Societies for paint Technology (1970). Radiation-curable urethane coatings may also of course be used.

In one preferred embodiment of the invention, the substrate is conventional latex seal coated flooring felt on which a layer of foamable PVC plastisol has been coated and gelled. A design has preferably also been printed on the gelled foamable layer with a suppressant ink formulation. In accordance with the invention, a continuous layer of clear PVC plastisol or organosol is then coated onto the substrate and gelled. A discontinuous layer of the same or a different PVC plastisol or organosol is then applied by rotogravure printing with the areas of application of the discontinuous layer preferably being in register with the suppressant ink pattern so that when the product is subsequently cured, the valleys resulting from the areas of suppressant ink correspond to the areas in which the second PVC layer has been applied by rotogravure printing.

In practicing the invention, the first, continuous layer of PVC or polyurethane may be applied in any suitable manner, such as by direct roll coating. This layer may vary widely in thickness, but is usually between about 4 and about 25 mils thick for PVC and about 1 and about 5 mils for urethane.

The second, discontinuous printed layer is applied by rotogravure printing, and should normally be applied so as to have a thickness between about 0.25 and about 2 mils. Rotogravure cylinders of between about 50 and about 150 lines per inch are preferably used in order to provide the desired difference in gloss effect between the continuous coating and the discontinuous coating. Etch depth is usually between about 25 and about 75 microns.

In practicing the invention, it is as mentioned above possible to use either the same or a different coating for the discontinuous coating than is used for the continuous coating. Maximum variation in gloss is generally obtained where coatings of different gloss characteristics are used, although a significant difference in gloss will be obtained where coatings of the same gloss characteristics are used such as when identical coatings are used.

The term "dual gloss coating" as used herein is intended to refer to a coating in which selected areas of the coating have different gloss characteristics from other areas of the coating. The 60° gloss meter test (ASTM D23-67) is a standard test for evaluating gloss and is the basis for gloss values referred to herein. It is generally preferred that in practicing the invention the coatings be selected so that the product has a dual gloss coat wherein selected areas of the coating have a gloss at least about 20 units higher or lower than the gloss of the remaining areas of the coating. This much gloss difference can be obtained while using the same coating material for both the continuous and discontinuous coatings of the invention. In a preferred embodiment, however, a low gloss coating material is preferably used for one of the coatings, usually the discontinuous coating and a high gloss coating material is preferably used for the other coating, usually the continuous coating. In this embodiment it is preferred that the two materials differ from each other by at least about 20 units of gloss when individually direct roll coated and cured. As used herein, the term "low gloss" refers to materials having a gloss after direct roll coating and curing of less than about 30 units while high gloss refers to materials having a gloss after direct roll coating and curing of at least about 50 units. Low gloss coatings preferably have between about 10 and about 30 units of gloss while high gloss coatings preferably have between about 50 and about 85 units of gloss. The discontinuous coating preferably has Brookfield viscosity prior to application of between about 100 and 2000 centipoisis.

As mentioned above, it is essential to the practice of the invention that the first continuous coating be at least partially cured before application of the second discontinuous coating. As used herein, the term "partially cured" is intended to refer to gelling of PVC plastisol or organosol or sufficient curing by drying or chemical cross linking of polyurethane coatings so that printing of ink or additional coating material onto the surface of the partially cured layer is feasible. The terms "curing," "cured," etc. are intended to apply to fusing of PVC plastisol or organosol as well as to air drying or chemical cross linking of polyurethane materials.

In practicing the invention, the various layers applied may, with the exception of the rotogravure printed layer which must be applied by rotogravure printing, be applied in any conventional manner such as by the use direct or reverse roll coaters or knife coating. Where foamable layers are used conventional foamable PVC plastisols or organosols are preferred. Such materials contain conventional blowing agents such as azodicarbonamide (ABFA) or other conventional blowing agents such as those mentioned in U.S. Pat. No. 3,458,337. Likewise where a pattern of suppressant ink is applied to suppress the blowing agent, the suppressant ink used may be any conventional ink containing suitable suppressants such as benzotriazole or the various other suppressants mentioned in U.S. Pat. No. 3,458,337.

In partially curing the first continuous layer of the invention prior to application of the discontinuous layer, it is important where a foamable layer is present to avoid foaming the foamable layer prematurely. Since typical blowing agent systems have decomposition temperatures between about 300° F. and about 400° F., suitable gelling or partial curing conditions for use in partially curing the continuous layer of the invention typically involve exposure to temperatures of for instance about 250° F. for times of between about 2 and about 4 minutes or higher temperatures for correspondingly shorter periods of time. Even higher temperature may, of course, be used provided the temperature of the foamable layer of material does not reach the decomposition temperature of the blowing agent. Once both the continuous and discontinuous layers of the invention have been applied, then the entire product may be cured under suitable conditions to completely cure the various layers and foam any foamable material present. In the case of PVC plastisols or organosols exposure to temperature between about 300° and about 400° F. for between about 1 and about 3 minutes is generally sufficient to accomplish such complete curing.

The following example is intended to illustrate the practice of the invention without limiting the scope thereof.

EXAMPLE

A continuous 15 mil thick layer of high gloss (70 gloss units) PVC was direct roll coated onto a gelled foamable PVC substrate and was gelled by heating in an air oven at 275° F. for 2½ minutes. A rotogravure printing cylinder having 125 lines per inch and an etch depth of 50 microns was then used to apply a low gloss (20 gloss units) PVC coating to selected areas of the gelled high gloss coaing. The viscosity of the low gloss coating prior to application was 350 cp. The entire laminate product was then cured in an air oven for 3 minutes at 360° F.

While the invention has been described above with respect to certain embodiments thereof, it will be appreciated that various changes and modifications may be made without departing from the spirit or scope of the invention.

What is claimed is:

1. Method for forming a dual gloss coating on a substrate which comprises:

(a) applying to the substrate a first, continuous layer of curable polyurethane or PVC plastisol or organosol and at least partially curing same;

(b) then applying with a rotogravure cylinder to selected areas of the surface of the thus at least partially cured continuous layer a second, discontinuous, printed layer of the same or a different curable polyurethane or PVC plastisol or organosol, said rotogravure cylinder having a number of lines per inch sufficient to produce a difference in gloss effect between the discontinuous layer and continuous layer after curing of said layers; and (c) then completing the curing of both said layers.

2. Method according to claim 1 wherein the rotogravure printed discontinuous layer is applied with a rotogravure cylinder of between about 50 and about 150 lines per inch.

3. Method according to claim 1 wherein the continuous layer is a PVC layer between about 4 and about 25 mils thick and the discontinuous layer is between about 0.25 and about 2 mils thick.

4. Method according to claim 1 wherein the continuous layer is PVC plastisol or organosol and is gelled before application of the discontinuous layer.

5. Method for forming a decorative covering that has areas of distinct high and low gloss which comprises:

(a) applying to a substrate a first continuous layer of curable PVC plastisol or organosol and partially curing same;

(b) then printing a design on said first continuous layer;

(c) then coating the printed, first continuous layer with a second continuous layer of clear, curable polyurethane or PVC plastisol or organosol and at least partially curing same;

(d) then applying with a rotogravure cylinder of between about 50 and about 150 lines per inch a third, discontinuous, rotogravure printed layer of the same or a different curable, non-foamable, PVC plastisol, PVC organosol or polyurethane in register with the pattern of the printed design, said number of lines per inch being sufficient to produce a difference in gloss effect between the continuous and discontinuous layers, and (e) then completing the curing of the various layers thereby forming rotogravure printed areas in the product in register with the printed design having different gloss characteristics from the remaining areas of the product.

6. The method of claim 5, wherein the first continuous layer is foamable, is partially cured without foaming, and is foamed as a result of said complete curing.

7. The method of claim 5, wherein the first continuous layer is curable, but non-foamable.

8. The method of claim 5, wherein the substrate is a latex seal coated flooring felt.

9. The method of claim 6 wherein said design is printed with a foam suppressant ink containing as the suppressant agent a material selected from the class consisting of benzotriazole, aminotriazole, 8-hydroxyquinoline and N-phenyl glycine so that upon said complete curing valleys are formed in the product in register with the suppressant ink coated part of the rotogravure printed design.

10. The method of claim 5 wherein said polyurethane is of the aliphatic or cycloaliphatic type.

11. The method of claim 5 wherein the said second continuous layer is a high gloss polyurethane wear layer and said third discontinuous layer is a low gloss polyurethane wear layer.

12. The method of claim 5 wherein the said second continuous layer is a low gloss polyurethane wear layer and said third discontinuous layer is a high gloss polyurethane wear layer.

13. The method of claim 5 wherein the said second continuous layer is a high gloss PVC plastisol or organosol wear layer and said third discontinuous layer is a low gloss PVC plastisol or organosol wear layer.

14. The method of claim 5 wherein the said second continuous layer is a low gloss PVC plastisol or organosol wear layer and said third discontinuous layer is a high gloss PVC plastisol or organosol wear layer.

15. The method of claim 5 wherein the said second continuous layer is a high gloss polyurethane wear layer and said third discontinuous layer is a low gloss PVC plastisol or organosol wear layer.

16. The method of claim 5 wherein the said second continuous layer is a low gloss polyurethane wear layer and said third discontinuous layer is a high gloss PVC plastisol or organosol wear layer.

17. The method of claim 5 wherein the said second continuous layer is a low gloss PVC plastisol or organosol wear layer and said third discontinuous layer is a high gloss polyurethane wear layer.

18. The method of claim 5 wherein the said second continuous layer is a high gloss PVC plastisol or organosol wear layer and said third discontinuous layer is a low gloss polyurethane wear layer.

* * * * *